US009738953B2

(12) United States Patent
Osaki et al.

(10) Patent No.: US 9,738,953 B2
(45) Date of Patent: Aug. 22, 2017

(54) HOT-FORGEABLE NI-BASED SUPERALLOY EXCELLENT IN HIGH TEMPERATURE STRENGTH

(71) Applicants: Mototsugu Osaki, Aichi (JP); Shigeki Ueta, Aichi (JP); Takuma Okajima, Aichi (JP); Ayumi Hori, Aichi (JP)

(72) Inventors: Mototsugu Osaki, Aichi (JP); Shigeki Ueta, Aichi (JP); Takuma Okajima, Aichi (JP); Ayumi Hori, Aichi (JP)

(73) Assignee: DAIDO STEEL CO., LTD., Aichi (JP)

( * ) Notice: Subject to any disclaimer, the term of this patent is extended or adjusted under 35 U.S.C. 154(b) by 449 days.

(21) Appl. No.: 14/167,370

(22) Filed: Jan. 29, 2014

(65) Prior Publication Data

US 2015/0284823 A1 Oct. 8, 2015

(30) Foreign Application Priority Data

Jul. 12, 2013 (JP) ..... 2013-146973
Dec. 4, 2013 (JP) ..... 2013-251116

(51) Int. Cl.
*C22C 19/05* (2006.01)

(52) U.S. Cl.
CPC ..... *C22C 19/056* (2013.01); *C22C 19/055* (2013.01)

(58) Field of Classification Search
None
See application file for complete search history.

(56) References Cited

U.S. PATENT DOCUMENTS 3,785,876 A * 1/1974 Bailey ..... C22F 1/10 148/556
5,820,700 A * 10/1998 DeLuca ..... C22C 19/057 148/404
8,066,938 B2 11/2011 Pike, Jr.
2003/0213536 A1 11/2003 Cao
2006/0051234 A1 3/2006 Pike, Jr.
2006/0222557 A1 10/2006 Pike, Jr.
2010/0008778 A1 1/2010 Patrick et al.
2012/0183432 A1 7/2012 Devaux et al.
2013/0052077 A1* 2/2013 Hardy ..... C22C 19/056 420/443
2014/0199164 A1* 7/2014 Feng ..... C22C 19/05 415/200
2014/0348689 A1* 11/2014 Hardy ..... B22F 3/17 419/29

FOREIGN PATENT DOCUMENTS

CN 1718802 A 1/2006
CN 1743483 A 3/2006
JP 09-268337 10/1997

OTHER PUBLICATIONS

Extended European Search Report for European Patent application No. 14153229.1, mail date Mar. 2, 2015.
Office Action issued in Chinese Counterpart Patent App. No. 201410043886.8, dated Jan. 5, 2017 , along with an English translation thereof.

* cited by examiner

*Primary Examiner* — George Wyszomierski
(74) *Attorney, Agent, or Firm* — Greenblum & Bernstein, P.L.C.

(57) ABSTRACT

The present invention provides a hot-forgeable Ni-based superalloy excellent in high temperature strength, including, in terms of % by mass: C: more than 0.001% and less than 0.100%, Cr: 11.0% or more and less than 19.0%, Co: 0.5% or more and less than 22.0%, Fe: 0.5% or more and less than 10.0%, Si: less than 0.1%, Mo: more than 2.0% and less than 5.0%, W: more than 1.0% and less than 5.0%, Mo+½W: 2.5% or more and less than 5.5%, S: 0.010% or less, Nb: 0.3% or more and less than 2.0%, Al: more than 3.00% and less than 6.50%, and Ti: 0.20% or more and less than 2.49%, with the balance being Ni and unavoidable impurities, in which (Ti/Al)×10 is 0.2 or more and less than 4.0 in terms of atomic ratio, and in which Al+Ti+Nb is 8.5% or more and less than 13.0% in terms of atomic %.

9 Claims, No Drawings

HOT-FORGEABLE NI-BASED SUPERALLOY EXCELLENT IN HIGH TEMPERATURE STRENGTH

FIELD OF THE INVENTION

This invention relates to a hot-forgeable Ni-based superalloy excellent in high temperature strength.

BACKGROUND OF THE INVENTION

The strengthening mechanism for Ni-based superalloy is roughly classified into three kinds, that is, solid solution strengthening, carbide precipitation strengthening, and γ' (gamma prime)·γ" (gamma double prime) precipitation strengthening, and among these, γ'-strengthened superalloy utilizing strengthening by γ' precipitation of an intermetallic compound composed of $Ni_3Al$, $Ni_3(Al,Ti)$ or $Ni_3(Al,Ti,Nb)$ has been widely used.

The γ'-strengthened Ni-based superalloy exhibits excellent strength properties in a high-temperature environment by virtue of the precipitation of γ' (gamma prime) working out to a strengthening phase by an aging treatment.

In the case of a γ'-strengthened Ni-based superalloy, the strength at a high temperature can be more enhanced by increasing the γ' amount. The γ' amount varies according to the amount added of the forming element such as Al, Ti and Nb, and the precipitation amount can be made large by increasing the amount added of the forming element.

On the other hand, when the γ' amount is increased by adding the forming element such as Ti, Al and Nb in a large amount, the solid solution temperature of γ' rises, and the workability at hot forging is worsened. That is, in a γ'-strengthened Ni-based superalloy, the high-temperature strength and the hot forgeability are in a trade-off relationship.

In particular, in the case where the forming element such as Ti, Al and Nb is added in excess of a given amount, the workability becomes so bad that the hot forging can be no longer performed.

Accordingly, an alloy where the forming element such as Ti, Al or Nb is added in excess of a given amount to precipitate a large amount of γ' phase allows only casting to produce a target member.

However, a member requiring excellent high-temperature strength, for example, a member requiring high strength properties in a high-temperature environment, such as gas turbine of aircraft or for electricity generation, power-generating steam turbine exposed to high-temperature/high-pressure environment typified by A-USC, high output automobile engine component and heat-resistant spring, is preferably formed by forging capable of achieving build-up of a texture via a wrought process, because sufficiently high strength is not obtained by the casting.

In recent years, a material exhibiting excellent high-temperature strength properties while maintaining hot workability has been developed.

For example, a forging alloy excellent in high temperature strength is disclosed in the following Patent Documents 1 and 2.

The alloys disclosed in these Patent Documents can be worked by hot forging but are a hardly workable material.

In the case of a large-sized member such as disc material used in gas turbine, steam turbine and the like, high deformation needs to be added so as to build up the internal texture via a wrought process, but because of difficulty in employing a forging method involving addition of high deformation, it is difficult to apply the hardly workable material to a large-sized member.

Incidentally, in the following Patent Document 3 that is another related art of the present invention, from the standpoint of enhancing the life of a turbine blade, a forged high-corrosion-resistant and heat-resistant superalloy having a composition composed of, in terms of % by weight, C: 0.015% or less, Si: 1.0% or less, Mn: 0.5% or less, Cr: from 15 to 25%, Co: 20% or less, one or two of Mo and W: 7% or less in terms of Mo+½W, Al: from 0.4 to 3%, Ti: from 0.6 to 4%, one or two of Nb and Ta: 6% or less in terms of Nb+½Ta, Re: from 0.05 to 2%, and Fe: 20% or less, and wherein Al+½Ti+¼Nb+⅛Ta is from 2 to 4.5%, with the balance of Ni, is disclosed as an alloy for improving not only the conventional strength but also the resistance to corrosion.

However, all of the alloys described in this Patent Document 3 and the above-described Patent Documents 1 and 2 differ from the superalloy of the present invention in that the amount added of Al as a basic constituent component of γ' is smaller than in the present invention.

Patent Document 1: US-A1-2003-0213536
Patent Document 2: US-A1-2012-0183432
Patent Document 3: JP-A-119-268337

SUMMARY OF THE INVENTION

Under these circumstances, an object of the present invention is to provide an Ni-based superalloy excellent not only in high-temperature strength but also in hot forgeability.

Namely, the present invention provides the following items.

1. A hot-forgeable Ni-based superalloy excellent in high temperature strength, comprising, in terms of % by mass:
C: more than 0.001% and less than 0.100%,
Cr: 11.0% or more and less than 19.0%,
Co: 0.5% or more and less than 22.0%,
Fe: 0.5% or more and less than 10.0%,
Si: less than 0.1%,
Mo: more than 2.0% and less than 5.0%,
W: more than 1.0% and less than 5.0%,
Mo+½W: 2.5% or more and less than 5.5%,
S: 0.010% or less,
Nb: 0.3% or more and less than 2.0%,
Al: more than 3.00% and less than 6.50%, and
Ti: 0.20% or more and less than 2.49%,
with the balance being Ni and unavoidable impurities,
wherein (Ti/Al)×10 is 0.2 or more and less than 4.0 in terms of atomic ratio, and
wherein Al+Ti+Nb is 8.5% or more and less than 13.0% in terms of atomic %.

2. The hot-forgeable Ni-based superalloy excellent in high temperature strength according to item 1, wherein:
Fe: 1.0% or more and less than 10.0%.

3. The hot-forgeable Ni-based superalloy excellent in high temperature strength according to item 2, further comprising one or more species selected from, in terms of % by mass:
B: 0.0001% or more and less than 0.03%, and
Zr: 0.0001% or more and less than 0.1%.

4. The hot-forgeable Ni-based superalloy excellent in high temperature strength according to item 2 or 3, wherein, in terms of % by mass:
P: less than 0.020%, and
N: less than 0.020%.

5. The hot-forgeable Ni-based superalloy excellent in high temperature strength according to any one of items 2 to 4, further comprising one or more species selected from, in terms of % by mass:

Mg: 0.0001% or more and less than 0.030%,

Ca: 0.0001% or more and less than 0.030%, and

REM: from 0.0001% to 0.200%.

DETAILED DESCRIPTION OF THE INVENTION

With respect to the γ'-strengthened Ni-based superalloy, addition of a larger amount of Ti than Al has been considered to be effective from the standpoint of enhancing the mechanical properties, and Ti has been added in a large amount as compared with Al.

However, Ti is a component having a high melting point. In the case where Ti is added in a large amount, the solid solution temperature of γ' (gamma prime) rises, and, as a result, the hot forgeability of the Ni-based superalloy is worsened.

In this connection, the present invention is intended to satisfy both hot forgeability and high-temperature strength properties by decreasing the Ti amount and increasing the Al amount while ensuring a γ' amount on the same level as in conventional alloys.

Al is low in the melting point as compared with Ti and even when the amount added thereof is increased, the solid solution temperature of γ' is not elevated for the increase.

In the present invention, both hot forgeability and high-temperature strength properties are satisfied by preventing the solid solution temperature of γ' from rising due to an increase in the Al amount, while maintaining, in terms of components, the amount of Al+Ti+Nb at the same level as in conventional alloys.

The reasons for limitation on the chemical components in the present invention are described below.

C: more than 0.001% and less than 0.100%

C combines with Cr, Nb, Ti, W, Mo or the like to produce various carbides. Among carbides, those having a high solid solution temperature, here, mainly Nb-based and Ti-based carbides, exhibit a pinning effect to suppress coarsening growth of a crystal grain at high temperatures and thereby contribute to improvement of hot workability.

Also, mainly Cr-based, Mo-based and W-based carbides precipitate in the grain boundary to achieve grain boundary strengthening and thereby contribute to improvement of mechanical properties.

However, if C is added excessively, the carbide amount becomes excessive, and this causes segregation or the like of carbide, giving rise to unevenness of the structure, or causes excessive precipitation or the like of grain boundary carbide, leading to reduction in the hot workability and mechanical properties. For this reason, in the present invention, the C content is limited to the range above. The preferred range is more than 0.001% and 0.090% or less. The more preferred range is from 0.010 to 0.080%.

Si: less than 0.1%

By adding Si, improvement of oxidation resistance is promoted due to an Si oxide scale layer. However, localized production of a low-melting-point part occurs due to segregation or the like of Si, as a result, hot workability is reduced. For this reason, in the present invention, the content is limited to less than 0.1%. The preferred range is 0.09% or less.

Co: 0.5% or more and less than 22.0%

Co improves workability by forming a solid solution in an austenite base that is the matrix of the Ni-based superalloy, and at the same time, promotes precipitation of γ' phase to enhance high-temperature strength such as tensile properties. However, Co is expensive and disadvantageous in view of cost and therefore, the upper limit is fixed. The preferred range is 6.5% or more and less than 22.0%. The more preferred range is from 8.0% to 21.5%. Moreover, in order to achieve high-temperature strength, the particularly preferred range is from 13.5% to 21.5%.

Fe: 0.5% or more and less than 10.0%

Fe forms a solid solution in an austenite phase that is the matrix, and when added in a small amount, does not affect the strength properties/workability. Also, Fe is a component mixed according to the selection of raw materials at the alloy production and although the Fe content may become large depending on the selection of raw materials, the addition of Fe leads to reduction in the raw material cost. However, if Fe is added in a large amount, the strength is reduced, and therefore, the amount added is preferably kept as low as possible. The acceptable amount of incorporation of Fe is the above-described value of less than 10.0%. The content of Fe is preferably kept in the range of from 1.0% to 8.0%, and more preferably kept in the range of from 1.0% to 6.0%.

Mo: more than 2.0% and less than 5.0%

W: more than 1.0% and less than 5.0%

Mo+½W: 2.5% or more and less than 5.5%

Mo and W are a solid solution strengthening element and strengthen the alloy by forming a solid solution in the austenite phase having an FCC structure, which is the matrix of the Ni-based superalloy. Also, both Mo and W combine with C to produce a carbide.

However, excessive addition promotes production of a Sigma phase or a Laves phase, which are a harmful phase, and gives rise to reduction in the hot workability and mechanical properties. For this reason, the Mo content is limited to be more than 2.0% and less than 5.0%, and the W content is limited to be more than 1.0% and less than 5.0%. As for the preferred content, Mo is from 2.1% to 4.0%, and W is from 1.2% to 3.4%. As for the more preferred content, Mo is from 2.5% to 3.7%, and W is from 1.6% to 3.0%.

Incidentally, Mo has a small atomic weight as compared with W and since the atomic weight of this element contained per unit mass % is large, its contribution to the solid solution strengthening amount is large. Therefore, in the case of obtaining the same solid solution strengthening amount by the addition of W, it is necessary to increase the amount of addition of W. The solid solution strengthening amount of Mo and W can be quantified by Mo+½W from the difference in the atomic weight therebetween. In the present invention, Mo+½W is limited to be 2.5% or more and less than 5.5%.

Cr: 11.0% or more and less than 19.0%

Cr forms a protective oxide film of $Cr_2O_3$ and is an element indispensable for corrosion resistance/oxidation resistance. Also, this element contributes to enhancement of strength properties by combining with C to produce $Cr_{23}C_6$ carbide.

However, Cr is a ferrite stabilizing element, and its excessive addition brings about austenite destabilization to thereby promote production of a Sigma phase or a Laves phase, which are brittle phase, and cause a reduction in hot workability and mechanical properties such as strength properties and impact properties. For this reason, the amount added thereof is limited to the range above. The preferred content is 13.5% or more and less than 18.5%. The more preferred content is from 14.0% to 17.5%.

Nb: 0.3% or more and less than 2.0%

Ti: 0.20% or more and less than 2.49%

Nb and Ti enhance the pinning effect of suppressing coarsening of a crystal grain after solid-solution heat treatment by combining with C to produce an MC-type carbide having a relatively high solid solution temperature and are effective in improving high-temperature strength properties and hot workability.

Also, both Nb and Ti act to bring about solid solution strengthening of γ' by being substituted on the Al site of γ' (gamma prime) phase-$Ni_3Al$ which is a strengthening phase and becoming $Ni_3(Al,Ti,Nb)$, and in turn, effectively improve the high-temperature strength properties.

However, their excessive addition causes an increase in the solid solution temperature of γ', giving rise to a reduction in the hot workability, and brings about the production of a Laves phase as a brittle phase, leading to a decrease in the high-temperature strength. For this reason, the amounts added of these components are limited to the ranges above.

Also, Ti reduces the high-temperature strength properties by the precipitation of $Ni_3Ti$ as an η (Eta) phase and therefore, the content thereof is limited to the range above. As for the preferred range, Ti is from 0.3% to 2.3%, and Nb is from 0.4 to 1.8%. As for the more preferred range, Ti is from 0.5% to 2.2%, and Nb is from 0.7% to 1.6%.

Al: more than 3.00% and less than 6.50%

Al acts as an element for producing γ' phase-$Ni_3Al$ which is a strengthening phase and is an important element particularly for improvement of high-temperature strength properties.

Al raises the solid solution temperature of γ' but the effect on the rise of solid solution temperature is small as compared with Nb and Ti, and this element is effective in increasing the precipitation amount of γ' in the aging temperature region while suppressing a rise in the solid solution temperature of γ'.

Furthermore, Al combines with O to form a protective oxide film of $Al_2O_3$ and thus, is effective also for improvement of corrosion resistance/oxidation resistance.

However, excessive addition of Al may cause a rise in the solid solution temperature of γ' and reduction in the hot workability due to an increase in the precipitation amount of γ'. For this reason, the amount added thereof is limited to the range above. The amount added is preferably from 3.20% to 5.90%, and more preferably from 3.20% to 4.70%.

(Ti/Al)×10: 0.2 or more and less than 4.0 in terms of atomic ratio

Al+Ti+Nb: 8.5% or more and less than 13.0% in terms of atomic %

As apparent from the above, the total amount of Al+Ti+Nb is a parameter indicative of the amount of γ' in the actual use temperature region, for example, at 730° C., and if this amount is small, the mechanical properties are at a low level, whereas if the amount is too large, the solid solution temperature of γ' as a strengthening factor rises to make hot working difficult. For this reason, the total amount of Al+Ti+Nb is limited to be 8.5% or more and less than 13.0% in terms of atomic %.

The Ti/Al ratio is an important factor to stabilize γ' in the practical temperature region and enhance the mechanical properties. In the specification, Ti/Al ratio shows a value obtained by dividing the amount of Ti represented by atomic % (Ti (atomic %)) by the amount of Al represented by atomic % (Al (atomic %)). If the tenfold value of the Ti/Al ratio is a low value not reaching 0.2, this is disadvantageous in that the aging is slow and sufficient strength is not obtained, whereas if the value is a high value of 4.0 or more, the η phase as a brittle is likely to precipitate, giving rise to a problem that the strength is reduced. Also, the Ti amount increases and therefore, the solid solution temperature of γ' rises, making hot working difficult. By properly selecting the Ti/Al ratio×10 in the range of 0.2 or more and less than 4.0, enhancement of the mechanical properties can be successfully achieved.

S: 0.010% or less

S is a component unavoidably contained in a small amount as an impurity and when exists excessively, is thickened in the grain boundary to produce a low-melting-point compound, incurring a reduction in hot workability. For this reason, the amount of this component is limited to 0.010% or less.

B: 0.0001% or more and less than 0.03%

Zr: 0.0001% or more and less than 0.1%

B and Zr segregate in the crystal grain boundary to strengthen the grain boundary and improve the workability and mechanical properties. This effect is obtained when each component is added in an amount of 0.0001% or more. However, if B is contained at a ratio of 0.03% or more or Zr is contained at a ratio of 0.1% or more, the ductility is impaired due to excessive segregation in the grain boundary and in turn, the hot workability is reduced. For this reason, the upper limits are less than 0.03% and less than 0.1%, respectively.

Mg: 0.0001% or more and less than 0.030%

Ca: 0.0001% or more and less than 0.030%

These elements contribute to enhancement of hot workability of the alloy when added as a deoxidizing or desulfurizing agent during alloy melting. This effect is observed even when the amount added is as small as 0.0001%, but if the amount added becomes 0.030% or more, the workability tends to be rather reduced.

REM: from 0.0001 to 0.200%

REM is an additive element effective for hot workability and oxidation resistance and by the addition in a small amount, and oxidation resistance as well as hot workability can be enhanced. However, excessive addition of REM brings thickening in the grain boundary to reduce the melting point and rather incurs a reduction in hot workability. For this reason, the amount added is limited to 0.200% or less.

N: less than 0.020%

N combines with Ti or Al to produce a nitride TiN or AlN. This nitride is an inclusion unavoidably produced due to containing N and remains in the material to become a starting point of breakage and cause a reduction in the mechanical properties. For this reason, N is limited as an impurity to less than 0.020%, preferably limited to 0.015% or less and more preferably limited to 0.013% or less.

P: less than 0.020%

P is unavoidably mixed in a small mount but excessive content of P incurs a reduction in ductility to impair the hot workability and high-temperature mechanical properties. For this reason, in the present invention, P is limited as an impurity to less than 0.020%, preferably limited to less than 0.018% and more preferably limited to less than 0.015%.

In this regard, with regard to each element contained in the Ni-based superalloy of the present invention, according to an embodiment, the minimal amount thereof may be the amount in any one of the Examples as summarized in Table 1-I. According to a further embodiment, the maximum amount thereof may be the amount in any one of the Examples as summarized in Table 1-I. Furthermore, with regard to each value of Mo+½W, Al+Ti+Nb and Ti/Al×10 regarding the Ni-based superalloy of the present invention, according to an embodiment, the minimal value thereof may be the value in any one of the Examples as summarized in Table 1-I. According to a further embodiment, the maximum value thereof may be the value in any one of the Examples as summarized in Table 1-I.

EXAMPLES

Working examples of the present invention are described in detail below.

50 kg of an Ni-based superalloy having chemical components shown in Table 1 was melted in a high-frequency induction furnace. The molten ingot was subjected to a homogenization heat treatment at 1,100 to 1,220° C. for 16 hours and then evaluated for workability by hot-forging the ingot into a bar material of 30 mm in diameter.

TABLE 1-I

Chemical Composition (in terms of % by mass, provided that Al + Ti + Nb and Ti/A1 × 10 are excluded therefrom)

| Example | Fe | Co | Cr | W | Mo | Nb | Al | Ti | C | Si | P | N | S | Others | Mo + ½W | Al + Ti + Nb (at %) | (Ti/Al) × 10 (atomic ratio) |
|---|---|---|---|---|---|---|---|---|---|---|---|---|---|---|---|---|---|
| 1 | 2.5 | 9.0 | 16.0 | 2.5 | 3.2 | 0.5 | 4.0 | 0.8 | 0.03 | 0.08 | <0.003 | <0.002 | <0.001 | | 4.45 | 9.6 | 1.1 |
| 2 | 3.8 | 1.7 | 15.3 | 3.2 | 3.0 | 1.1 | 3.7 | 0.5 | 0.03 | 0.07 | <0.003 | 0.003 | 0.002 | | 4.60 | 9.1 | 0.8 |
| 3 | 4.3 | 9.8 | 16.0 | 2.5 | 3.0 | 1.6 | 4.3 | 0.4 | 0.01 | 0.08 | <0.003 | <0.002 | <0.001 | | 4.25 | 10.4 | 0.5 |
| 4 | 4.6 | 9.5 | 16.3 | 2.0 | 2.3 | 0.9 | 3.8 | 1.2 | 0.05 | 0.06 | <0.003 | 0.003 | 0.005 | | 3.30 | 9.8 | 1.8 |
| 5 | 4.2 | 1.3 | 16.5 | 1.8 | 2.2 | 1.5 | 3.4 | 0.8 | 0.04 | 0.07 | 0.003 | <0.002 | <0.001 | | 3.10 | 9.0 | 1.3 |
| 6 | 3.6 | 9.1 | 17.6 | 2.6 | 2.7 | 0.8 | 4.0 | 1.3 | 0.01 | 0.09 | <0.003 | <0.002 | 0.006 | | 4.00 | 10.3 | 1.8 |
| 7 | 3.7 | 6.7 | 17.2 | 2.3 | 3.0 | 1.4 | 3.3 | 1.4 | 0.03 | 0.05 | <0.003 | 0.002 | <0.001 | | 4.15 | 9.4 | 2.4 |
| 8 | 4.1 | 9.6 | 16.8 | 2.8 | 3.8 | 0.7 | 3.9 | 0.5 | 0.09 | 0.06 | 0.008 | <0.002 | <0.001 | | 5.20 | 9.2 | 0.7 |
| 9 | 5.2 | 8.8 | 13.7 | 3.4 | 3.7 | 1.8 | 3.6 | 0.6 | 0.07 | 0.07 | 0.004 | <0.002 | 0.001 | | 5.40 | 9.5 | 0.9 |
| 10 | 4.5 | 9.0 | 16.0 | 3.3 | 2.2 | 1.4 | 3.4 | 2.1 | 0.04 | 0.04 | <0.003 | 0.003 | <0.001 | | 3.85 | 10.5 | 3.5 |
| 11 | 5.4 | 8.9 | 15.2 | 2.1 | 3.6 | 0.8 | 4.0 | 0.8 | 0.05 | 0.03 | <0.003 | 0.003 | 0.002 | | 4.65 | 9.8 | 1.1 |
| 12 | 3.1 | 9.6 | 14.8 | 3.3 | 2.6 | 0.4 | 4.3 | 1.5 | 0.08 | 0.09 | 0.003 | <0.002 | <0.001 | | 4.25 | 11.0 | 2.0 |
| 13 | 4.3 | 7.4 | 18.1 | 3.9 | 2.3 | 1.2 | 4.5 | 0.7 | 0.04 | 0.07 | <0.003 | <0.002 | <0.001 | | 4.25 | 10.9 | 0.9 |
| 14 | 3.8 | 9.8 | 16.0 | 2.2 | 3.5 | 0.5 | 4.6 | 0.5 | 0.07 | 0.07 | <0.003 | <0.002 | 0.002 | | 4.60 | 10.4 | 0.6 |
| 15 | 4.1 | 8.8 | 17.2 | 1.3 | 4.5 | 1.7 | 3.5 | 0.9 | 0.07 | 0.08 | <0.003 | 0.003 | <0.001 | | 5.15 | 9.4 | 1.4 |
| 16 | 2.3 | 8.3 | 15.4 | 2.4 | 3.1 | 1.5 | 4.2 | 0.8 | 0.05 | 0.08 | <0.003 | <0.002 | <0.001 | | 4.30 | 10.6 | 1.1 |
| 17 | 4.1 | 9.2 | 15.8 | 2.4 | 3.0 | 1.1 | 4.1 | 0.8 | 0.05 | 0.09 | <0.003 | 0.002 | <0.001 | 0.014 B, 0.025 Zr | 4.20 | 10.2 | 1.1 |
| 18 | 3.9 | 9.0 | 16.1 | 2.5 | 2.9 | 1.2 | 4.0 | 0.9 | 0.04 | 0.04 | <0.003 | 0.007 | <0.001 | 0.016 B | 4.15 | 10.1 | 1.3 |
| 19 | 3.9 | 8.9 | 15.9 | 2.5 | 3.1 | 1.1 | 3.9 | 0.9 | 0.06 | 0.05 | <0.003 | <0.002 | <0.001 | 0.032 Zr | 4.35 | 9.9 | 1.3 |
| 20 | 3.8 | 8.8 | 16.3 | 2.4 | 2.9 | 1.3 | 3.9 | 0.8 | 0.05 | 0.07 | <0.003 | <0.002 | 0.001 | | 4.10 | 9.9 | 1.2 |
| 21 | 3.9 | 9.0 | 16.1 | 2.3 | 3.1 | 1.2 | 4.2 | 0.9 | 0.04 | 0.03 | <0.003 | <0.002 | <0.001 | 0.013 Ca | 4.25 | 10.5 | 1.2 |
| 22 | 3.9 | 8.8 | 15.8 | 2.5 | 3.0 | 1.1 | 4.0 | 0.8 | 0.05 | 0.08 | <0.003 | <0.002 | <0.001 | 0.010 Mg | 4.25 | 10.0 | 1.1 |
| 23 | 3.7 | 9.2 | 16.5 | 2.6 | 3.2 | 0.4 | 6.0 | 0.3 | 0.06 | 0.08 | <0.003 | <0.002 | <0.001 | | 4.50 | 12.8 | 0.3 |
| 24 | 4.2 | 9.1 | 16.3 | 2.4 | 3.1 | 0.5 | 5.8 | 0.4 | 0.05 | 0.05 | <0.003 | <0.002 | <0.001 | | 4.30 | 12.6 | 0.4 |
| 25 | 3.9 | 9.1 | 16.0 | 2.4 | 3.0 | 1.2 | 4.1 | 0.9 | 0.04 | 0.05 | <0.003 | <0.002 | <0.001 | REM: 0.100 | 4.20 | 10.3 | 1.2 |
| 26 | 0.7 | 8.8 | 15.2 | 2.2 | 3.1 | 0.9 | 3.8 | 1.2 | 0.04 | 0.04 | <0.003 | <0.002 | <0.001 | | 4.20 | 9.9 | 1.8 |
| 27 | 1.2 | 9.1 | 15.8 | 2.6 | 2.9 | 1.1 | 4.1 | 1.1 | 0.06 | 0.05 | <0.003 | <0.002 | <0.001 | | 4.20 | 10.5 | 1.5 |
| 28 | 4.1 | 21.3 | 16.3 | 2.5 | 2.8 | 1.2 | 4.1 | 1.9 | 0.06 | 0.03 | <0.003 | <0.002 | <0.001 | | 4.05 | 11.5 | 2.6 |
| 29 | 5.8 | 20.8 | 15.8 | 1.7 | 3.4 | 1.0 | 3.6 | 2.2 | 0.05 | 0.01 | <0.003 | <0.002 | <0.001 | | 4.25 | 10.7 | 3.4 |
| 30 | 4.3 | 21.2 | 16.7 | 2.9 | 2.6 | 1.4 | 3.7 | 1.9 | 0.03 | 0.02 | <0.003 | <0.002 | <0.001 | | 4.05 | 10.9 | 2.9 |
| 31 | 3.8 | 14.5 | 17.2 | 1.6 | 2.5 | 0.9 | 4.5 | 2.0 | 0.03 | 0.05 | <0.003 | <0.002 | <0.001 | | 3.30 | 12.1 | 2.5 |
| 32 | 3.7 | 16.7 | 16.0 | 2.3 | 3.1 | 1.0 | 3.8 | 1.3 | 0.04 | 0.03 | <0.003 | <0.002 | <0.001 | | 4.25 | 10.1 | 1.9 |
| 33 | 1.2 | 13.8 | 14.3 | 2.5 | 3.1 | 0.8 | 3.8 | 0.7 | 0.07 | 0.05 | <0.003 | <0.002 | <0.001 | | 4.35 | 9.3 | 1.0 |

TABLE 1-II

Chemical Composition (in terms of % by mass, provided that Al + Ti + Nb and Ti/Al × 10 are excluded therefrom)

| Comparative Example | Fe | Co | Cr | W | Mo | Nb | Al | Ti | C | Si | P | N | S | Others | Mo + ½W | Al + Ti + Nb (at %) | (Ti/Al) × 10 (atomic ratio) |
|---|---|---|---|---|---|---|---|---|---|---|---|---|---|---|---|---|---|
| 1 | 4.5 | 8.5 | 16.3 | 2.2 | 3.3 | 1.2 | 2.5 | 3.4 | 0.01 | 0.03 | 0.003 | <0.002 | 0.002 | | 4.40 | 10.1 | 7.7 |
| 2 | 5.3 | 13.0 | 10.0 | 3.3 | 2.3 | 1.5 | 3.2 | 3.9 | 0.04 | 0.04 | <0.003 | <0.002 | 0.007 | | 3.95 | 12.4 | 6.9 |
| 3 | — | 12.0 | 19.0 | 0.9 | 6.0 | — | 2.0 | 3.0 | 0.05 | 0.04 | 0.004 | <0.002 | 0.007 | | 6.45 | 7.8 | 8.4 |
| 4 | 1.2 | 12.8 | 16.2 | 3.9 | 3.8 | 0.5 | 1.9 | 4.0 | 0.03 | 0.05 | <0.003 | <0.002 | <0.001 | | 5.75 | 9.3 | 11.9 |
| 5 | 5.3 | 11.0 | 15.8 | 5.3 | 3.2 | 1.3 | 3.8 | 1.4 | 0.13 | 0.80 | 0.003 | <0.002 | <0.001 | | 5.85 | 10.6 | 2.1 |
| 6 | 4.3 | 8.9 | 15.8 | 2.6 | 2.9 | 1.3 | 3.8 | 1.4 | 0.03 | 0.02 | 0.032 | <0.002 | <0.001 | | 4.20 | 10.4 | 2.1 |
| 7 | 3.7 | 9.3 | 16.2 | 2.3 | 3.2 | 1.4 | 3.9 | 1.1 | 0.04 | 0.03 | 0.003 | 0.033 | <0.001 | | 4.35 | 10.3 | 1.6 |
| 8 | 11.5 | 8.3 | 17.1 | 2.6 | 3.1 | 1.4 | 4.1 | 1.2 | 0.01 | 0.04 | 0.003 | <0.002 | 0.005 | 0.040 B | 4.40 | 10.8 | 1.6 |
| 9 | 2.6 | 8.4 | 15.5 | 2.8 | 3.3 | 1.2 | 3.6 | 1.4 | 0.02 | 0.05 | <0.003 | 0.003 | <0.001 | 0.200 Zr | 4.70 | 10.0 | 2.2 |
| 10 | 4.2 | 9.1 | 15.8 | 3.1 | 3.2 | 2.5 | 3.1 | 1.9 | 0.02 | 0.02 | 0.003 | <0.002 | 0.023 | | 4.75 | 10.4 | 3.5 |

TABLE 1-II-continued

| Chemical Composition (in terms of % by mass, provided that Al + Ti + Nb and Ti/Al × 10 are excluded therefrom) | | | | | | | | | | | | | | | | | |
|---|---|---|---|---|---|---|---|---|---|---|---|---|---|---|---|---|---|
| Comparative Example | Fe | Co | Cr | W | Mo | Nb | Al | Ti | C | Si | P | N | S | Others | Mo + ½W | Al + Ti + Nb (at %) | (Ti/Al) × 10 (atomic ratio) |
| 11 | 1.3 | 21.0 | 17.6 | 1.8 | 2.5 | 0.4 | 2.8 | 0.3 | 0.02 | 0.03 | <0.003 | 0.004 | <0.001 | | 3.40 | 6.5 | 0.6 |
| 12 | 8.8 | 16.0 | 18.0 | 4.2 | 5.5 | 1.5 | 4.3 | 2.3 | 0.05 | 0.08 | <0.003 | 0.003 | 0.002 | | 7.00 | 12.7 | 3.0 |
| 13 | — | 10.5 | 19.0 | 2.5 | 3.0 | 1.3 | 6.8 | 1.5 | 0.05 | 0.05 | <0.003 | <0.002 | 0.002 | | 4.25 | 16.2 | 1.2 |

Also, the hot-forged material was subjected to a solid-solution heat treatment (ST) at 1,000 to 1,160° C. and then to an aging treatment (AG) at 700 to 900° C. in one step or two or more steps and evaluated for the high-temperature strength. As for the evaluation of strength, a high-temperature tensile test at 730° C. was performed.

In addition, using the material in the cast state, the solid solution temperature of γ' (gamma prime) as a strengthening phase was measured by DSC (differential scanning calorimetric analysis).

Furthermore, the material after the aging treatment was further subjected to a long-time heat treatment at 730° C. for 200 hours and after performing γ' extraction by electrolytic extraction, the γ' amount was examined.

These results are shown in Table 2.

Incidentally, the forging, measurement of solid solution temperature of γ' by DSC, high-temperature tensile test and measurement of γ' by electrolytic extraction were performed using the following conditions or methods.

[Forging]

In the forging, a press forging machine of 500 t (ton) was used and after a homogenization heat treatment satisfying the above-described conditions, working was performed by setting the soaking temperature of material to a range of 1,150 to 1,180° C. At this time, the forging was performed while keeping its termination temperature of 1,050° C. or more.

As shown in Table 2, the workability was evaluated by rating "A" when forging into a round bar of 30 mm in diameter could be performed with no trouble, and rating "B" when the working was difficult due to generation of a crack during working.

TABLE 2

| | Solid Solution Temperature of Gamma Prime (° C.) | Forging | Gamma Prime Amount at 730° C. (mol %) | 0.2% Proof Stress at 730° C. (MPa) | Tensile Strength at 730° C. (MPa) |
|---|---|---|---|---|---|
| Example | | | | | |
| 1 | 1042 | A | 36.6 | 930 | 1074 |
| 2 | 1025 | A | 35.2 | 923 | 1043 |
| 3 | 1064 | A | 39.4 | 980 | 1103 |
| 4 | 1056 | A | 36.2 | 940 | 1078 |
| 5 | 1034 | A | 34.3 | 920 | 1038 |
| 6 | 1078 | A | 40.7 | 997 | 1112 |
| 7 | 1063 | A | 35.4 | 947 | 1060 |
| 8 | 1028 | A | 33.9 | 935 | 1047 |
| 9 | 1034 | A | 35.4 | 945 | 1053 |
| 10 | 1067 | A | 41.2 | 1003 | 1110 |
| 11 | 1034 | A | 36.5 | 942 | 1070 |
| 12 | 1070 | A | 42.1 | 998 | 1104 |
| 13 | 1068 | A | 41.2 | 996 | 1100 |
| 14 | 1051 | A | 41.0 | 1006 | 1108 |
| 15 | 1045 | A | 34.3 | 923 | 1041 |

TABLE 2-continued

| | Solid Solution Temperature of Gamma Prime (° C.) | Forging | Gamma Prime Amount at 730° C. (mol %) | 0.2% Proof Stress at 730° C. (MPa) | Tensile Strength at 730° C. (MPa) |
|---|---|---|---|---|---|
| 16 | 1078 | A | 41.9 | 986 | 1097 |
| 17 | 1058 | A | 38.6 | 963 | 1083 |
| 18 | 1057 | A | 38.2 | 960 | 1079 |
| 19 | 1054 | A | 38.1 | 965 | 1082 |
| 20 | 1061 | A | 37.9 | 957 | 1080 |
| 21 | 1059 | A | 39.7 | 953 | 1081 |
| 22 | 1062 | A | 39.4 | 962 | 1084 |
| 23 | 1073 | A | 44.5 | 1030 | 1142 |
| 24 | 1074 | A | 43.1 | 1025 | 1140 |
| 25 | 1060 | A | 37.5 | 990 | 1086 |
| 26 | 1071 | A | 38.2 | 980 | 1103 |
| 27 | 1068 | A | 41.9 | 985 | 1106 |
| 28 | 1067 | A | 40.3 | 995 | 1150 |
| 29 | 1065 | A | 39.8 | 1020 | 1141 |
| 30 | 1065 | A | 41.2 | 1017 | 1148 |
| 31 | 1066 | A | 42.6 | 995 | 1123 |
| 32 | 1067 | A | 40.2 | 996 | 1131 |
| 33 | 1058 | A | 39.0 | 974 | 1103 |
| Comparative Example | | | | | |
| 1 | 1106 | B | 39.8 | — | — |
| 2 | 1150 | B | 49.7 | — | — |
| 3 | 1065 | A | 30.0 | 745 | 860 |
| 4 | 1091 | B | 41.4 | — | — |
| 5 | 1073 | B | 39.3 | — | — |
| 6 | 1082 | B | 40.2 | — | — |
| 7 | 1073 | B | 39.7 | — | — |
| 8 | 1075 | B | 39.8 | — | — |
| 9 | 1075 | B | 38.5 | — | — |
| 10 | 1093 | B | 41.0 | — | — |
| 11 | 1023 | A | 26.4 | 734 | 843 |
| 12 | 965 | B | 52.2 | — | — |
| 13 | 1134 | B | 53.3 | — | — |

[DSC Measurement]

A test specimen with a cubic shape of 2 mm was produced from the ingot in the cast state and measured by DSC using STA449C Jupiter manufactured by NETZSCH. The measurement was performed in an Ar atmosphere, and the solid solution temperature of γ' was measured by raising the temperature from room temperature to 1,240° C. at a rate of 10° C./min.

[High-Temperature Tensile Test]

The forged material above was subjected to a solid-solution heat treatment and then to an aging treatment in one step or two or more steps, and a test specimen with a parallel-part diameter of 8 mm and a gauge length of 40 mm in accordance with JIS G 0567 was produced therefrom and evaluated for the strength by performing a tensile test at a test temperature of 730° C. In this test, the 0.2% proof stress and the tensile strength were measured.

[Electrolytic Extraction]

The material subjected to the long-time heat treatment above was worked into a cubic shape of 10 mm and then, electrolytic extraction was performed at a current density of 25 mA/cm$^2$ for 4 hours in an aqueous solution containing 1% tartaric acid and 1% ammonium sulfate. The extraction residue was collected using a filter having a size of 0.1 micrometer and measured for the γ' amount. The result is shown by the molar fraction. Incidentally, in Comparative Examples where forging was difficult, the test specimen was produced using a cast alloy.

From the results in Table 2, the followings can be understood,

The solid solution temperature of γ' greatly affects the hot workability. In a precipitation-strengthened Ni-based superalloy for forging, when the solid solution temperature of γ' falls below a given value, aging precipitation of γ' occurs and in turn, the hardness rises. This means an increase in the deformation resistance during working and incurs the impairment of deformability. Usually, forging is performed in the matrix single-phase temperature region and therefore, the solid solution temperature of γ' serves as a parameter for the hot workability.

In Examples, the measurement result of solid solution temperature of γ' by DSC was substantially from 1,020 to 1,080° C., and working into a round bar was possible at the actual forging.

On the other hand, in Comparative Examples 1, 2, 4, 10 and 13, the solid solution temperature of γ' was high, and forging was difficult.

In Comparative Example 5, the solid solution temperature of γ' was low, C was added excessively. The strength was improved because of the effect of the carbide generated in the structure, deformation resistance was increased, contraction was decreased, and therefore, forging was difficult. Moreover, excessive addition of Si brought the decrease in melting point, hot workability was reduced, and the temperature range where hot workability was possible, as a result, hot workability was reduced.

In Comparative Example 6, the excessive addition of P caused the decrease of the ductility, as a result, hot workability was reduced, and forging was difficult.

In Comparative Examples 8 and 9, local melting was generated due to excessive addition of B or Zr and despite the low solid solution temperature of γ', working was difficult.

In Comparative Example 7, an inclusion such as TiN and AlN was produced due to excessive addition of N and became a starting point of forging crack, as a result, hot working was difficult.

In Comparative Example 12, the excessive addition of Mo brought production of a Sigma phase or a Laves phase, which are brittle phase, and therefore, forging was difficult.

Next, in Examples, the results of tensile test at 730° C. revealed high strength properties such that the 0.2% proof stress at 730° C. was approximately from 920 to 1,030 MPa and the tensile strength was approximately from 1,035 to 1,150 MPa.

On the other hand, in Comparative Examples 3 and 11, forging was possible but as compared with Examples, the strength properties were low. This is because the total amount of Ti+Al+Nb that are forming elements of γ' was at a low level and affected the strength properties.

With respect to the electrolytic extraction results of the material subjected to a long-time heat treatment at 730° C. for 200 hours, the materials of Examples had a γ' amount of about 35 to 42 mol %.

On the other band, the materials of Comparative Examples had a gamma prime amount of 38 to 53 mol %, and some had a precipitation amount at the same level as in Examples, but the forging was difficult.

Also, the γ' amount was 30 mol % in Comparative Example 3 and 26.4 mol % in Comparative Example 11 and thus was low as compared with Examples, and this well agrees with the result that the tensile properties exhibited were at a low level.

The γ' (gamma prime) amount is related to the total amount of Al, Ti and Nb as forming elements and at the same time, related to the solid solution temperature of γ'.

In general, when the total amount of Al+Nb+Ti is increased, both an increase in the γ' amount and a rise of the solid solution temperature of γ' are brought about, and forging becomes difficult due to a reduction in the hot workability resulting from an increase in the deformation resistance.

In the present invention, the Ti/AI ratio is made small or limited to a predetermined range while ensuring a large γ' precipitation amount in the aging treatment temperature region, whereby the solid solution temperature of γ' is kept low and in turn, an Ni-based superalloy having both excellent high-temperature strength properties in the high temperature region of 700° C. or more and hot workability is provided.

While the mode for carrying out the present invention has been described in detail above, the present invention is not limited to these embodiments, and various changes and modifications can be made therein without departing from the purport of the present invention.

This application is based on Japanese patent application No. 2013-146973 filed Jul. 12, 2013 and Japanese patent application No. 2013-251116 filed Dec. 4, 2013, the entire contents thereof being hereby incorporated by reference.

What is claimed is:

1. A hot-forgeable Ni-based superalloy, comprising, in terms of % by mass:

C: more than 0.001% and less than 0.100%,
Cr: 11.0% or more and less than 19.0%,
Co: 6.5% or more and less than 22.0%,
Fe: 0.5% or more and less than 10.0%,
Si: less than 0.1%,
Mo: more than 2.0% and less than 5.0%,
W: more than 1.0% and less than 5.0%,
Mo+½W: 2.5% or more and less than 5.5%,
S: 0.010% or less,
Nb: 0.3% or more and less than 2.0%,
Al: more than 3.00% and less than 6.50%, and
Ti: 0.20% or more and less than 2.49%,
with the balance being Ni and unavoidable impurities, wherein (Ti/Al)×10 is 0.2 or more and less than 4.0 in terms of atomic ratio, wherein Al+Ti+Nb is 8.5% or more and less than 13.0% in terms of atomic %; and wherein the hot-forgeable Ni-based superalloy has a γ' amount of from 34 mol % to 45 mol %; and the hot-forgeable Ni-based superalloy has a solid solution temperature of γ' of from 1,020° C. to 1,080° C.

2. The hot-forgeable Ni-based superalloy according to claim 1, wherein:

Fe: 1.0% or more and less than 10.0%.

3. The hot-forgeable Ni-based superalloy according to claim 2, further comprising one or more species selected from, in terms of % by mass:

B: 0.0001% or more and less than 0.03%, and

Zr: 0.0001% or more and less than 0.1%.

4. The hot-forgeable Ni-based superalloy according to claim 3, wherein, in terms of % by mass:

P: less than 0.020%, and

N: less than 0.020%.

5. The hot-forgeable Ni-based superalloy according to claim 4, further comprising one or more species selected from, in terms of % by mass:

Mg: 0.0001% or more and less than 0.030%,

Ca: 0.0001% or more and less than 0.030%, and

REM: from 0.0001% to 0.200%.

6. The hot-forgeable Ni-based superalloy according to claim 3, further comprising one or more species selected from, in terms of % by mass:

Mg: 0.0001% or more and less than 0.030%,

Ca: 0.0001% or more and less than 0.030%, and

REM: from 0.0001% to 0.200%.

7. The hot-forgeable Ni-based superalloy according to claim 2, wherein, in terms of % by mass:

P: less than 0.020%, and

N: less than 0.020%.

8. The hot-forgeable Ni-based superalloy according to claim 7, further comprising one or more species selected from, in terms of % by mass:

Mg: 0.0001% or more and less than 0.030%,

Ca: 0.0001% or more and less than 0.030%, and

REM: from 0.0001% to 0.200%.

9. The hot-forgeable Ni-based superalloy according to claim 2, further comprising one or more species selected from, in terms of % by mass:

Mg: 0.0001% or more and less than 0.030%,

Ca: 0.0001% or more and less than 0.030%, and

REM: from 0.0001% to 0.200%.

* * * * *